US005372218A

United States Patent [19]

Kesler

[11] Patent Number: 5,372,218

[45] Date of Patent: Dec. 13, 1994

[54] MINI PORTABLE SCAFFOLDING

[76] Inventor: Glen H. Kesler, 2839 S. 2910 W., West Valley City, Utah 84119

[21] Appl. No.: 154,090

[22] Filed: Nov. 18, 1993

[51] Int. Cl.[5] ..... E04G 1/32

[52] U.S. Cl. ..... 182/153; 182/225

[58] Field of Search ..... 182/152, 153, 181, 154, 182/223, 224

[56] References Cited

U.S. PATENT DOCUMENTS 4,454,939 6/1984 Wellman ..... 182/181 X
4,609,070 9/1986 Parps et al. ..... 182/181 X

FOREIGN PATENT DOCUMENTS 0214882 10/1984 Germany ..... 182/224

*Primary Examiner*—Alvin C. Chin-Shue
*Attorney, Agent, or Firm*—Richard F. Bojanowski

[57] ABSTRACT

A mini portable scaffolding frame having a structure and design such that it can receive and hold a removable extension member. When two scaffolding frames and its extensions are positioned in a spaced apart relation to receive the placement of wooden planks thereon, a scaffolding system is provided which can be used in small indoor areas which normally could not receive standard scaffolding structures. Each of the frame members includes a pair of rectangular sections pivotally mounted to each other. A base member is fixed to each of the rectangular sections for receiving and holding a detachable extension member.

6 Claims, 2 Drawing Sheets

MINI PORTABLE SCAFFOLDING

BACKGROUND OF THE INVENTION

1. Field of the Invention

This invention relates generally to a scaffolding framework or support structure and more particularly to a mini, portable scaffolding system for use by artisans in relatively confined areas.

2. Description of the Prior Art

There are many types of scaffolding currently being used by craftsmen in the construction and repair of buildings, rooms and other structures. The most common is a temporary metal or wooden framework installed for the purpose of supporting workmen and supplies at preselected levels. Scaffolding for use indoors is generally of the "make do" variety, using block and boards, ladders, chairs, saw horses and the like to achieve the desired lengths and heights. The use of such items generally results in an unsafe working environment as both the materials and the workmen are exposed to conditions not designed for stable support and balance. In most cases, the scaffolding now in use has a limited application as the framework and planks are designed primarily for outdoor use and have standard lengths of about fifteen feet. It is therefore highly desirable to have a rigid, safe and inexpensive portable scaffolding that can be used outdoors but is especially well suited for use indoors and within relatively small areas such as porches, closets, bathrooms and stairways.

SUMMARY OF THE INVENTION

Brick masons, carpenters, dry wall craftsman, stucco contractors and painters are generally the two types of craft people who will require scaffolding for use indoors and will benefit the most from scaffolding that is portable, lightweight and safe. This type of scaffolding is not limited to construction work as it may be used by members of a household for cleaning, repairing and painting rooms within a house with relative ease and safety. In work areas having narrow widths or lengths such as less than 10 feet, it is virtually impossible to use scaffolding designed primarily for outdoor use. Most outdoor scaffolding, for example, is designed to use planks 16 feet long and, when set up, have at least a seven foot width. Outdoor scaffolding is also designed so that the weight of the scaffold, craftsman and materials is carried and distributed to four legs which causes instability and can cause damage to indoor flooring unless precautions are taken.

It is therefore highly desirable to have a reliable, portable and inexpensive mini-scaffold that can be used outdoors but is particularly useful indoors. Accordingly it is an object of this invention to provide a scaffolding system particularly designed for use indoors and within a limited area. Another object is to provide a framework, capable of being used as scaffolding, which is rigid, portable and economical. Still, another object is to provide a scaffolding frame work that is designed to more evenly distribute the weight of the stock and the workmen carried by the scaffold, A related object of this invention is to provide a quick, safe and convenient means for increasing the height of a section of the scaffolding an additional two to four feet if the need unexpectedly arises.

DESCRIPTION OF THE PREFERRED EMBODIMENT

Figure 1:
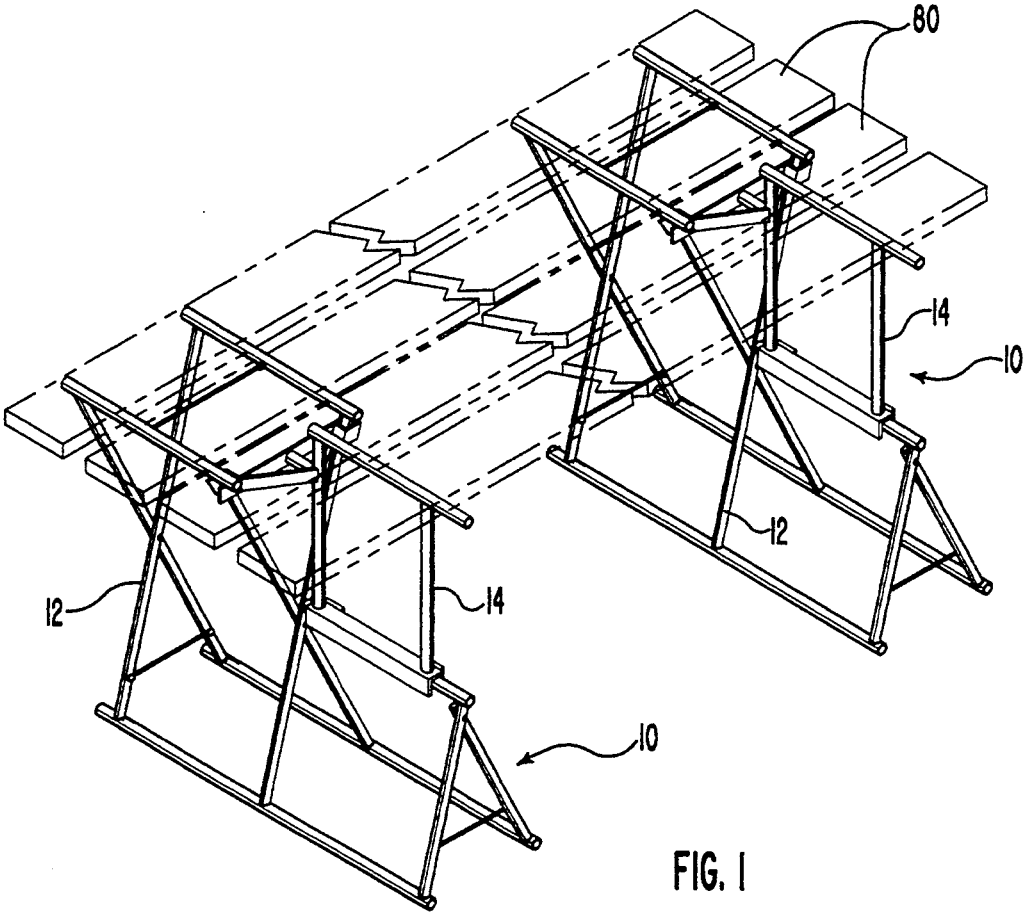
FIG. 1 is an isometric view depicting the adaption of a pair of spaced apart scaffold support frames with removable extensions positioned thereon for supporting overlying planks depicted in phantom.
Figure 2:
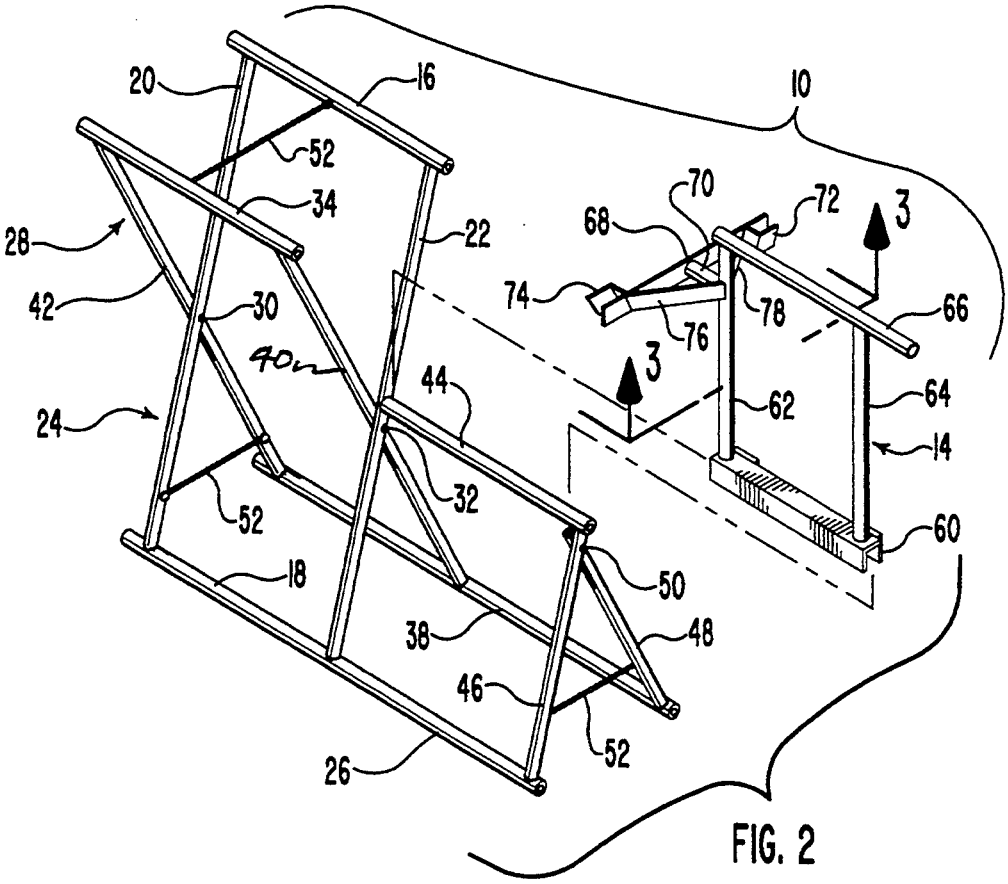
FIG. 2 is an isometric exploded view depicting the positional relationship of a scaffold support frame and a removable extension.

Referring to the attached illustrations and particularly to FIGS. 1 and 2, there is illustrated a mini scaffold represented generally by the numeral 10. The mini-scaffold includes a pair of spaced apart scaffolding frameworks or support structures 12 with removable extensions 14. As shown in FIG. 1, the extensions 14 are positioned and locked on each of the support structures. The support structures are spaced apart and planks 80 (shown in phantom) carried thereon. Since the support structure and extensions are identical only one of the structures will be described thereinafter in detail.

In FIG. 2, the main support structure is depicted generally by the numeral 12 and the extension by the numeral 14. This figure also shows in exploded view how the extension 14 can be positioned and locked to support structure 12 and thereby provide additional height for stock and workmen.

Figure 5:
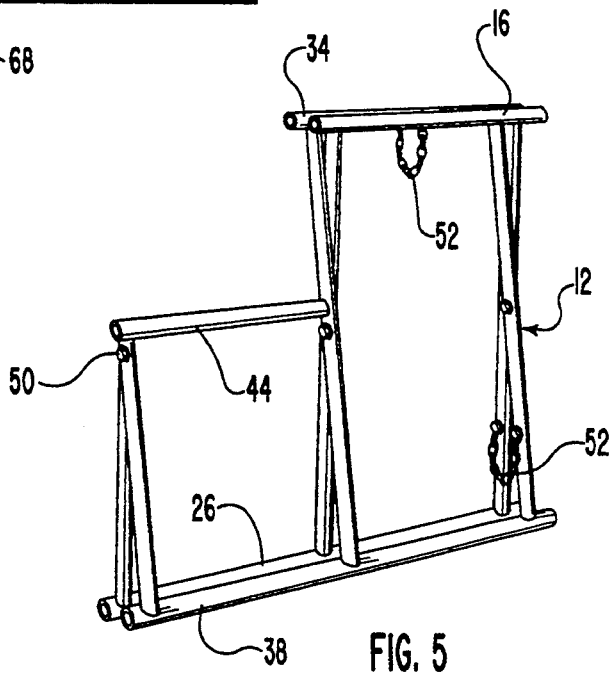
FIG. 5 is a three dimensional view of the scaffold support frame in a collapsed mode.

The scaffolding support structure 12 is preferably constructed from 120 wall one inch steel tubing. However, other materials may be used including other metals, alloys and reinforced plastics. The steel tubing is preferred because of availability, strength, durability and cost. The scaffolding support structure in its open and extended mode, as opposed to its dosed and collapsed mode as depicted in FIG. 5, includes a first upper horizontal member 16 and a first lower horizontal ground member 18 joined to a first outside vertical member 20 and first inside vertical member 22 to form a substantially rigid first rectangular section shown generally by the number 24. The use of the terms vertical, horizontal, inside and outside to describe the above structural elements is made with reference to the ground surface, upon which the structure will normally rest. The first lower horizontal ground member 18 has a length approximately twice that of the first upper horizontal member 16 to provide an extension 26 thereof. A second rectangular section depicted generally by the numeral 28 and which is similar to the first rectangular section 24 is pivotally maintained within the first rectangular section at pivotal points 30 and 32. The second rectangular section 28 includes a second upper horizontal member 34 and a second lower horizontal ground member 36 also containing an extension 38. A second inside vertical member 40 and a second outside vertical member 42 are fixed to the horizontal members to complete the second rectangular section 28. It should be noted that the second rectangular section is preferably somewhat narrower in width so that it may be pivotally mounted within the first rectangular section. This embodiment is not shown in the drawings. This form of construction permits either of the first or second rectangular sections to be readily replaced if, for any reason, one of the sections becomes damaged. This can be accomplished by removing the nuts and bolts (not specifically shown) which comprise the pivotal points 30, 32 and 50. Pivotal points 30 and 32 therefore include a bolt which passes through aligned openings in the first and second rectangular sections and positionally secured therein to permit pivotal movement by a nut. However, this is not essential to the construction or use of this invention. Pivotal point 50 shall be discussed subsequently in this specification.

Fixed to the first inside vertical member at its end section is a third horizontal member 44 which in turn is fixed at approximately a right angle to one of the ends of a first short vertical member 46. The other end of the first short vertical member is fixed to the extension 26 of the first lower horizontal ground member 18. A second short vertical member 48 is fixed at one of its ends to the extension 38 of the second horizontal ground member 36. The other end of the second short vertical member 48 is pivotally mounted to said first short vertical member 46 at pivotal point 543. Pivotal points 30, 32 and 50 are all in the same horizontal plane of alignment and thereby permitting the support structure 12 to be collapsed to a closed mode or position as depicted in FIG. 5.

To restrict the opening of the support structure 12 about pivotal points 30, 32 and 50 to a preselected distance, chains 52 of a preselected length are provided. To avoid excessive force being exerted on chains 52, they are preferably attached to the support structure at points furthermost from the pivotal points. As depicted in all figures, except FIG. 3, the chains are fastened near the bottom of the first and second outside vertical members 20 and 42 and near the bottom of the first and second short vertical members 46 and 46. For additional stability a third chain is fastened to the first and second upper horizontal members 16 and 34. The chains may also be of the adjustable variety and thereby provide a convenient means for raising and lowering the scaffold structure by decreasing and increasing the length of the chains respectively.

As an alternative to the construction just described, the extensions 26 and 38 may be severed from the lower horizontal members to form two independent horizontal pieces which may subsequently be rejoined to each other by welding or other forms of attachment. The former form of construction is generally preferred.

Figure 4:
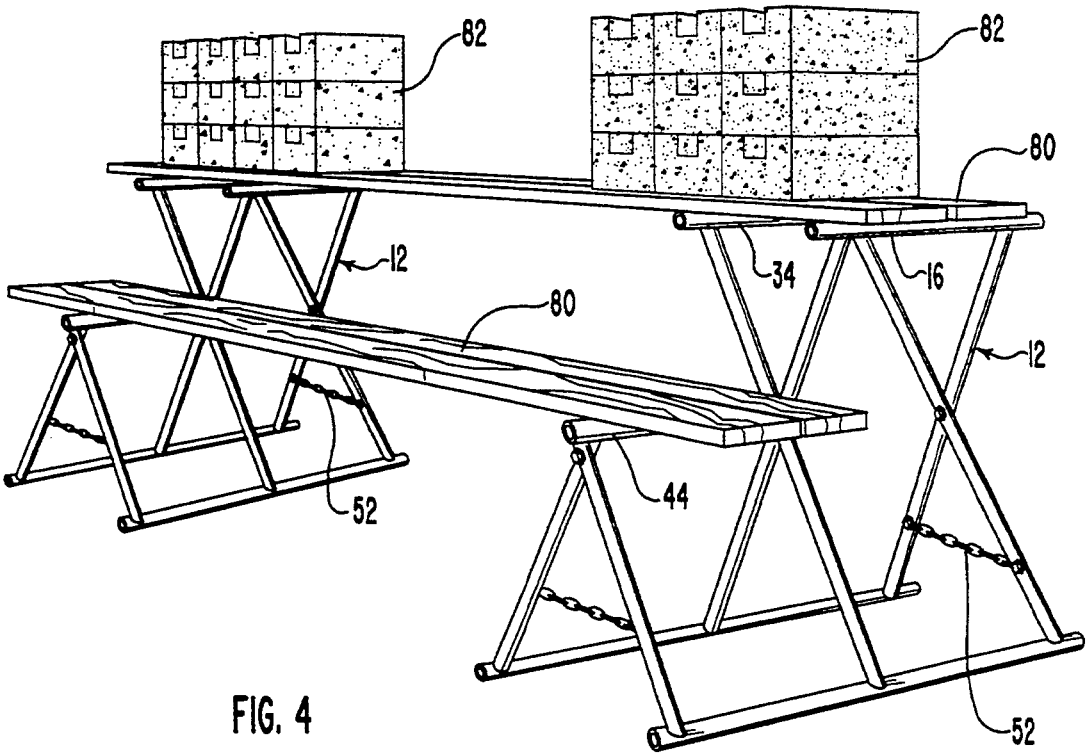
FIG. 4 is a perspective view showing the application of the scaffold support frame without extensions positioned thereon.

As heretofore described and as depicted in the drawings, a pair of support structure of this invention when placed in a spaced apart relation to each other and planks are positioned thereon as shown in FIG. 4, a double tiered, portable, scaffolding is provided. Materials, such as bricks and blocks, may be placed on the upper tier and the craftsman may stand on the lower tier during construction of a wall, staircase, closet, fireplace and the like. When construction elevation reaches a certain height, the craftsman may desire to increase the level of the lower tier to a level approximately the level of the upper tier. To achieve this, an extension frame generally shown by the numeral 14 may be positioned on the lower tier as depicted in FIGS. 1 and 2 without first removing planks and the stock resting thereon from the support structure.

The extension frame depicted generally by the numeral 14 includes an inverted "U" shaped base member 60 and a pair of upwardly extending vertical members 62 and 64. Fixed to each of the ends of the upwardly extending vertical members 62 and 64 is a fourth horizontal member 66 which is in substantially parallel relation to the base member 60. The resulting structure provides a substantially third rectangular frame member which, when positioned on the third horizontal member 44 will increase the level of the lower tier to approximately that of the first tier. To insure stability of the third rectangular frame member when positioned on the horizontal member, an outwardly extending arm 68 is fixed to the upwardly extending vertical member 62 by means of a spacer 70. The spacer is in a substantially perpendicular relationship to both the outwardly extending arm 68 and the upwardly extending vertical member 62. Generally "U" shaped couplings 72 and 74 are mounted to each end of the outwardly extending arm 68 for clasping the inside vertical members 22 and 40 respectively. Diagonal support members 76 and 78 are also provided for added stability. The angle at which the "U" shaped couplings are mounted to the outwardly extending arm as well as the dimensions of the couplings are such that they can firmly grasp and encompass the inside vertical members 22 and 40. This results in an extremely stable seating of the extension frame on the lower tier of the support structure 12. For example, if one inch tubing having an outer diameter of one inch is used in constructing the framework the "U" shaped couplings and the "U" shaped base member will have a width of slightly more than one inch to insure a snug fit about the steel tubing.

Figure 3:
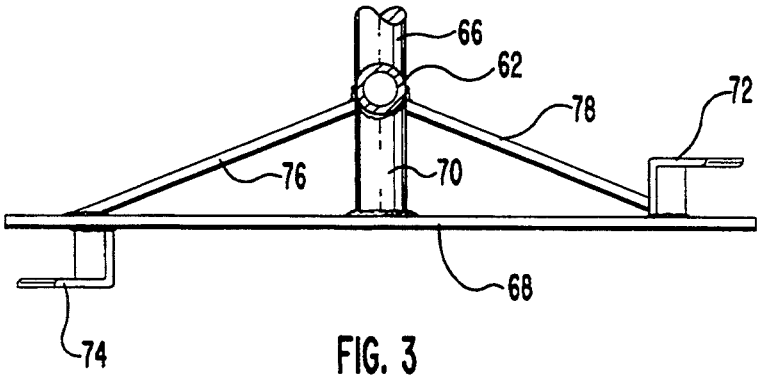
FIG. 3 is a front elevation view of an arm of the extension with a portion sectioned taken along line 3—3 of FIG. 2.

As more clearly shown in FIG. 3, coupling 74 is placed on the front side and coupling 72 is placed on the back side of the outwardly extending arm 68 to accommodate the pivotal positioning of the second rectangular section 28 within the first rectangular section 24. The couplings therefore are in alignment with and are capable of grasping the inside vertical members of the rectangular sections without creating structural stress.

In use, a pair of support structures shown generally by the numeral 12 are positioned in a preselected, spaced apart relationship as shown in FIG. 4. The support structures are extended to their fullest as determined by the chains 52. Planks 80 are placed on top of the horizontal members 16, 34 & 44 of each support structure to provide a stable lower and upper tier arrangement. The upper tier is normally used to carry materials such as the blocks 82 shown in FIG. 4. A craftsman, such as a brick mason, will generally stand on the lower tier to attain a level best suited for laying the blocks carried on the upper tier behind him. As the craftsman reaches a level during his construction which requires an additional height, the planks 80 are removed from the lower tier and the extension 14 is positioned and locked in place on the horizontal members 44. The planks are then replaced and the craftsman is able to continue on with his work at the increased level. When the craftsman's work is completed, the planks are removed and the support structures are collapsed into the folded position shown in FIG. 5 and conveniently removed from the work area.

Having illustrated and described a preferred embodiment of this invention, it is possible that certain modifications in arrangement and detail may be apparent to one skilled in the art. However, such modifications would not depart from the spirit and scope of the claims appended hereto.

I claim:

1. A scaffolding frame work comprising:

a) a first upper and lower horizontal member and a first inside and outside vertical member joined together at their ends to form a substantially rigid first rectangular section, said first lower horizontal member having a length greater than said first upper horizontal member to provide a first extension thereof;

b) a second upper and lower horizontal member and a second inside and outside vertical member joined together at their ends to form a substantially rigid second rectangular section, said second lower horizontal member having a length greater than said second upper horizontal member to provide a second extension thereof;

c) a first pivotal means pivotally connecting said first outside vertical member to said second outside vertical member;

d) a second pivotal means pivotally connecting said first inside member to said second inside vertical member;

e) a third horizontal member fixed about midway to one of said inside vertical members;

f) a first short vertical member fixed at one of its ends to said third horizontal member with the other end fixed to said first extension of said horizontal member;

g) a second short vertical member fixed at one of its ends to said second extension of said second horizontal member;

h) a third pivotal means pivotally connecting said second short vertical member at one of its ends to said first short vertical member at its end whereby said first, second and third pivotal means are all in substantially the same plane of alignment; and i) a means connected to one of said vertical members for restricting pivotal movement about said pivotal means.

2. A mini scaffold support frame comprising:

a) a pair of substantially rectangular sections pivotally connected at or near their vertical midsections to provide a scissor like linkage;

b) each rectangular section having a base member which extends outwardly and beyond said rectangular sections to provide a base extension thereof;

c) a horizontal member fixed at one of its ends to one of said rectangular sections;

d) a pair of legs pivotally attached at one of their ends to one of said legs being fixed to the other end of said horizontal member;

e) the other ends of said legs each being fixed to one of the ends of said base extension;

f) a third rectangular section is detachably seated on said horizontal member to provide an increase in height above said horizontal member.

3. The mini scaffold of claim 2 including a means for limiting the pivotal movement of said rectangular sections.

4. The mini scaffold of claim 3 including pivotal means for providing said pivotal connections and wherein said pivotal means are all in substantially the same plane of alignment.

5. The mini scaffold of claim 2 wherein said detachably seated third rectangular section includes an outwardly extending arm having a coupling fixed to each end of said arm for grasping said rectangular sections and thereby stabilizing said third rectangular section seated on said horizontal member.

6. The mini scaffold of claim 5 wherein said substantially rectangular sections are pivotally connected one within the other.

* * * * *